US010509432B2

(12) United States Patent
Jensen et al.

(10) Patent No.: US 10,509,432 B2
(45) **Date of Patent: *Dec. 17, 2019**

(54) TOY CONSTRUCTION SYSTEM COMPRISING A REMOTE CONTROL DEVICE

(71) Applicant: LEGO A/S, Billund (DK)

(72) Inventors: Jeppe Juul Jensen, Vejle (DK); René Bagnkop Wellejus, Vejle (DK); Kasper Mygind Pedersen, Viby J (DK)

(73) Assignee: LEGO A/S, Billund (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/756,939

(22) PCT Filed: Sep. 5, 2016

(86) PCT No.: PCT/EP2016/070895
§ 371 (c)(1),
(2) Date: Mar. 1, 2018

(87) PCT Pub. No.: WO2017/037301
PCT Pub. Date: Mar. 9, 2017

(65) Prior Publication Data

US 2018/0224881 A1 Aug. 9, 2018

(30) Foreign Application Priority Data

Sep. 4, 2015 (DK) ..... 2015-70571

(51) Int. Cl.
*A63H 17/00* (2006.01)
*G05G 1/10* (2006.01)
(Continued)

(52) U.S. Cl.
CPC ..... *G05G 1/10* (2013.01); *A63H 17/002* (2013.01); *A63H 17/262* (2013.01);
(Continued)

(58) Field of Classification Search
None
See application file for complete search history.

(56) References Cited

U.S. PATENT DOCUMENTS 6,340,800 B1 * 1/2002 Zhai ..... H01H 25/00 200/17 R
6,547,624 B1 * 4/2003 Bojesen ..... A63H 33/042 273/157 R
(Continued)

FOREIGN PATENT DOCUMENTS

CN 202654723 U * 1/2013
CN 202654723 U 1/2013
(Continued)

OTHER PUBLICATIONS

Communication issued in related European application No. EP 16 760 112.9, dated Mar. 15, 2019.
(Continued)

*Primary Examiner* — Tramar Y Harper
(74) *Attorney, Agent, or Firm* — Day Pitney LLP

(57) ABSTRACT

A toy construction system comprising toy construction elements (60) and at least one remote control device (10) and one or more remote controllable actuators (50); said remote control device (10) being configured for transmitting signals for controlling said one or more remote controllable actuators (50); said toy construction elements (60) comprising coupling members for detachably interconnecting the toy construction elements to create spatial structures comprising said one or more remote controllable actuators (50); said remote control device comprising one or more control units (21) configured such that a user may activate the remote control device by activating said one or more control units (21); wherein said one or more control units (21) are adjustable, such that a user can change the orientation of the
(Continued)

control unit with respect to the housing of the remote control device.

20 Claims, 5 Drawing Sheets

(51) Int. Cl.
*A63H 33/04* (2006.01)
*A63H 33/08* (2006.01)
*A63H 17/26* (2006.01)

(52) U.S. Cl.
CPC ..... *A63H 33/042* (2013.01); *A63H 33/086* (2013.01); *A63H 2200/00* (2013.01)

(56) References Cited

U.S. PATENT DOCUMENTS

| | | | | |
|---|---|---|---|---|
| 6,561,866 | B1 * | 5/2003 | Lee | A63H 33/042 446/103 |
| 6,620,022 | B1 * | 9/2003 | Smith | A63H 17/262 446/429 |
| 6,753,789 | B1 | 6/2004 | Batra et al. | |
| 6,773,321 | B1 * | 8/2004 | Urquiaga | A63H 17/28 446/454 |
| 6,939,192 | B1 | 9/2005 | Munch et al. | |
| 7,105,755 | B2 | 9/2006 | Imamura | |
| 7,298,311 | B2 * | 11/2007 | Horie | G06F 3/0231 340/815.78 |
| 2003/0122698 | A1 | 7/2003 | Horie et al. | |
| 2004/0041086 | A1 | 3/2004 | Imamura et al. | |
| 2004/0092207 | A1 * | 5/2004 | Hansen | A63H 30/04 446/454 |
| 2004/0137936 | A1 * | 7/2004 | Mukaida | A63H 30/04 455/550.1 |
| 2004/0248500 | A1 * | 12/2004 | Hatting | A63H 17/002 446/454 |
| 2006/0025217 | A1 | 2/2006 | Hussaini et al. | |
| 2007/0060393 | A1 | 3/2007 | Wu et al. | |
| 2008/0146117 | A1 * | 6/2008 | Tiburzi | A63H 11/02 446/358 |
| 2010/0248583 | A1 * | 9/2010 | Lin | A63H 30/04 446/91 |
| 2012/0161946 | A1 | 6/2012 | Ida et al. | |
| 2013/0331002 | A1 | 12/2013 | Amireh | |
| 2015/0360136 | A1 | 12/2015 | Choi | |
| 2016/0129358 | A1 * | 5/2016 | Eversoll | A63H 30/04 463/40 |
| 2017/0173485 | A1 * | 6/2017 | Liotta | A63H 33/086 |

FOREIGN PATENT DOCUMENTS

| | | | |
|---|---|---|---|
| CN | 203469479 | U | 3/2014 |
| DE | 2856402 | A1 | 7/1980 |
| EP | 0111680 | A2 | 6/1984 |
| EP | 1384500 | A1 | 1/2004 |
| GB | 1277946 | A | 6/1972 |
| WO | 2001097937 | A1 | 12/2001 |
| WO | 2003031007 | A1 | 4/2003 |
| WO | 2009047225 | A1 | 4/2009 |

OTHER PUBLICATIONS

Danish Search Report issued in related DK application No. PA 2015 70572, dated Apr. 4, 2016. (Translation unavailable.).
Danish Search Report issued in DK priority application No. PA 2015 70571, dated Apr. 4, 2016. (Translation unavailable.).
International Preliminary Report on Patentability issued in related international application No. PCT/EP2016/070896 together with amended sheets of specification and claims, dated Dec. 11, 2017.
International Preliminary Report on Patentability issued in corresponding international application No. PCT/EP2016/070895 together with amended sheets of specification and claims, dated Aug. 28, 2017.
International Search Report issued in corresponding international application No. PCT/EP2016/070895, dated Dec. 5, 2016.
International Search Report issued in related international application No. PCT/EP2016/070896, dated Nov. 21, 2016.
Written Opinion of the International Searching Authority issued in corresponding international application No. PCT/EP2016/070895, dated Dec. 5, 2016.
Written Opinion of the International Searching Authority issued in related international application No. PCT/EP2016/070896, dated Nov. 21, 2016.
Non-Final Office Action issued in related U.S. Appl. No. 15/756,927, dated Jan. 10, 2018.
Original Office Action issued in related Chinese application No. CN 201680051307.1, dated Aug. 26, 2019.
English Translation of Office Action issued in related Chinese application No. CN 201680051307.1, dated Aug. 26, 2019.

* cited by examiner

TOY CONSTRUCTION SYSTEM COMPRISING A REMOTE CONTROL DEVICE

CROSS-REFERENCE TO RELATED APPLICATIONS

This application is a U.S. National Stage of International Application No. PCT/EP2016/070895, filed on 5 Sep. 2016 and published on 9 Mar. 2017, as WO 2017/037301 A1, which claims the benefit of priority to Danish Patent Application No. DK PA201570571, filed on 4 Sep. 2015. The content of each of the above referenced patent applications is incorporated herein by reference in its entirety for any purpose whatsoever.

The present invention relates to a toy construction system comprising toy construction elements and at least one remote control device and one or more remote controllable actuators; said remote control device is configured for transmitting control signals for controlling said one or more remote controllable actuators; said toy construction elements comprise coupling members for detachably interconnecting the toy construction elements to create spatial structures comprising said one or more remote controllable actuators; said remote control device comprises one or more control units which are configured such that a user may activate the remote control device by activating said one or more control units.

BACKGROUND OF THE INVENTION

Various toy construction systems as well as remote control devices are well known.

The GB patent No. 1277946 discloses a remote control device 1 with two control sticks 12 arranged in a square plate 10 that may be selectively mounted by the user in different angular (90 degree rotation) positions in the housing of the remote control device. The purpose according to this patent is to provide the option of adapting the control stick configuration for controlling different devices such as an airplane, a ship or other remote controllable devices.

In many cases it is desirable to provide a more child-friendly and more intuitive toy allowing younger children to be able to construct, deconstruct and reconstruct spatial structures which may be controlled by a remote control device without the need of technical knowledge of signal transmitters and receivers and additionally to increase the possible variations of combinations.

BRIEF DESCRIPTION OF THE INVENTION

It is an object of the invention to provide a toy construction system that is easier to use and also enables younger children to independently construct a spatial structure and adapt the remote control device accordingly. Additionally, an object of the invention is to increases the possible variation opportunities of play.

This is achieved by said one or more control units being adjustable such that a user can change the orientation of the one or more controls unit with respect to the housing of the remote control device.

Hereby the user is able to adapt a remote control device for different uses by changing the configuration or direction of individual control units.

This results in increased variability of interaction between a spatial structure and a remote control device. For example, a user may construct a large variety of spatial structures, each defining different configurations of the one or more remote controllable actuators, and afterwards adapt the remote control device to the actual structure being controlled by the remote control device.

In an embodiment, said toy construction elements comprise at least two different types of coupling members, such as coupling studs and complementary coupling members.

In an embodiment, said remote control device comprises a touch screen which comprises said one or more adjustable control units, such that said one or more control units together defining at least a first and a second functional position, said one or more control units being configured to produce a first control signal when activated at said first functional position and to produce a second control signal when activated at said second functional position; said first control signal being configured to cause a first function having a first direction associated with it, and said second control signal being configured to cause a second function having a second direction associated with it, and where said second direction is opposite said first direction.

In an embodiment, said remote control device comprises a housing, one or more control units, one or more electromechanical interfaces and a transmitter; said one or more control units are functionally connected to said one or more electromechanical interfaces which are functionally connected to said transmitter; said one or more control units are connected to said one or more control bases, and wherein the one or more control bases are arranged rotatable about an axis of rotation relative to the housing of the remote control device, said one or more control units together defining at least a first and a second functional position relative to the one or more control bases, said first and second functional positions being located radially on opposite sides of said axis of rotation of said one or more control bases, said one or more control units being configured, regardless of the rotation of said one or more control bases, to produce a first control signal when activated at said first functional position and to produce a second control signal when activated at said second functional position; said first control signal being configured to cause a first function having a first direction associated with it, and said second control signal being configured to cause a second function having a second direction associated with it, and where said second direction is opposite said first direction.

In an embodiment, said one or more control units are configured for at a given time to produce either said first or said second control signal.

In an embodiment, said one or more control bases have a circular-shaped periphery rotatable arranged in the housing.

In an embodiment, at least part of the circular periphery of said one or more control bases are rotatable within said housing.

In an embodiment, said control bases are rotatable in an axis of rotation which is perpendicular to a plane defined by an outer surface of said housing.

In an embodiment, said one or more control bases are configured for being positioned in any random user-defined angle of rotation.

In an embodiment, each control base is structurally connected to one of the one or more electromechanical interfaces, said electromechanical interface(s) comprising at least two coaxially arranged annular rings having different radial diameters, said control bases and said annular rings being arranged coaxially along the axis of rotation.

In an embodiment, the electromechanical interface comprises three coaxially arranged annular rings having a radially increasing diameter to form an inner ring, an intermediate ring and an outer annular ring.

In an embodiment, each of the one or more control bases comprise one or more control units which are configured to provide at least two functional positions enabling each of the one or more control bases to provide two different sets of data to the transmitter by the control units.

In an embodiment, said one or more control units are shaped as two buttons, a sliding knob or in the form of a tiltable control stick.

In an embodiment, said one or more electromechanical interfaces comprise a coaxially arranged spring element which is configured for structurally connecting said spring element and said coaxially arranged annular rings, when an input is provided to said one or more control units.

In an embodiment, said spring element comprises a first and a second set of contact surfaces, said first and second sets of contact surfaces are positioned radially opposite each other in a distance from the axis of rotation, the first set of contact surfaces is configured for abutting said inner and said intermediate annular rings, respectively, and said second set of contact surfaces is configured for abutting said intermediate and outer annular rings.

In an embodiment, the remote control device comprises 1, 2, 4 or 6 control bases.

BRIEF DESCRIPTION OF THE INVENTION

Embodiments of the invention will be described in the following with reference to the drawings wherein FIG. 1 is perspective view of a remote control device, FIG. 2 is a perspective view of a signal receiver, FIG. 3 is a perspective view of a signal receiver with an integrated remote controllable actuator, FIG. 4 is a perspective view of a remote control device comprising a control base with control units illustrating change of polarity, FIG. 5 is a perspective view of a remote control device comprising a control base with control units illustrating changing direction (90 degrees clockwise), FIG. 6 is a perspective view of a remote control device comprising a control base with control units illustrating chancing direction to a random user-defined direction, FIG. 7 is a split sectional view of the housing, a control base and an electromechanical interface, FIG. 8 is a sectional view of a control base with a tiltable control unit, FIG. 9 illustrates a part of an electromechanical interface in a perspective view, FIG. 10 is a side view of a control unit and an electromechanical interface, FIG. 11 illustrates different embodiments of a control unit, FIG. 12 illustrates a spatial structure comprising toy construction elements, and FIG. 13 illustrates in a perspective view a remote control device comprising four rotatable control bases (20).

DETAILED DESCRIPTION OF THE INVENTION WITH REFERENCE TO THE FIGURES

The present invention relates to a remote control device.

Various aspects and embodiments of a remote control device for transmitting control signals to a controllable actuator (50) as disclosed herein will now be described with reference to the figures.

When relative expressions such as "upper" and "lower", "in front" and "in back", clockwise" and "counter clockwise" or similar are used in the following, these merely refer to the appended figures and not to an actual situation of use.

The remote control device (10) illustrated in FIG. 1 comprises a housing (11) and one control base (20) and two control units (21) in form of two buttons A and B.

A user may activate the remote control device by activating a control unit (21), such as press the button A so as to provide a control signal to be transmitted from the remote control device via the transmitter (13) to a remote controllable actuator (50).

The transmitter (13) is configured for transmitting a control signal to be read by a receiver (31) of a registration unit (30), which is illustrated in FIGS. 2 and 3.

The transmitter (13) is configured for transmitting control signals to be read by a receiver (31), said receiver (31) being functionally connected to the one or more remote controllable actuators; thus, the remote control device is configured for controlling the one or more remote controllable actuators (50).

In FIG. 2 the registration unit (30) comprises a receiver (31). The registration unit (30) is connected to a controllable actuator (50) via an external cable connection (40). This connection may be in form of a wireless connection. In the illustrated embodiment the registration unit (30) and the controllable actuator (50) are individual, separated units. The controllable actuator (50) provides a rotatable motion (R) to a rotatable shaft in a clockwise direction.

In FIG. 3 the registration unit (30) and the controllable actuator (50) are illustrated as one structural unit. The registration unit (30) comprises a receiver (31) and the registration unit (30) is connected functionally to the actuator (50) via an internal cable or wireless connection. The controllable actuator (50) is illustrated as providing a clockwise rotating movement (R).

A user may adapt the remote control device to the actual use, FIGS. 4-6 illustrate different examples of adaptions.

Generally, the control base (20) may comprise a marking, such as a dot as illustrated in FIG. 1, to indicate the orientation of the control base (20).

FIG. 4 illustrates the change of polarity. An example; the remote control device is used for driving a structure, such as a vehicle, where a controllable actuator (50) is used for turning the wheel of the vehicle. As the user presses the control unit (21) in the form of the button A, which is located in the front of the remote control device, the vehicle moves backwards, and when pressing the button B, which is located at the back of the remote control device, the vehicle drives forward.

This is illogical for the user and instead of deconstructing and reconstructing the vehicle comprising the controllable actuator (50), the user may adapt the remote control device.

The remote control device (10) is adapted to the specific use by simply turning the rotatable control base (20) 180 degrees clockwise around the axis of rotation (rA), for changing direction.

After rotation of the control base (20), the user has changed the behavior of the remote control. Now the two control units (21) in the form of buttons A and B have swapped positions, as button B is located in the front, and when pressing button B the vehicle moves forward, and likewise as button A now is located at the back, the vehicle more logically moves backward, when button A is pressed.

The control base (20) comprising the control units (21) allows the user to adapt the remote control device, as the control base (20) is adjustable.

FIG. 5 illustrates change of direction. A similar example as above, a structure, such as a vehicle, is constructed by toy building elements, and a controllable activator (50) is connected to the wheels. When the user presses the control input (21), in the form of the button A, which is located in the front of the remote control device, the vehicle turns left, and not as expected in a forward motion.

To change this, the user can turn the control base (20) including the two control units (21) 270 degrees clockwise around the axis of rotation (rA); such that the control unit (21) in the form of the button A is oriented in the left direction.

After rotating the control base (20) and the control unit (21), the user has changed the behavior of the remote control device. Now, when pressing the button A, which is now positioned to the left on the remote control device (10), the vehicle steers to the left.

In the illustrated embodiments the control base (20) can rotate freely both clockwise and counterclockwise. However, the one or more control bases (20) may comprise one or more restriction elements, such as a ratchet, which restricts movement in one direction and allows movement in the opposite direction, by means of angled teeth in which a pawl, cog or tooth engages, allowing motion in one direction only. The restriction elements may be configured to allow the one or more control bases (20) to rotate and be set in 90 degrees intervals around the axis of rotation (rA).

FIG. 6 illustrates a user defined change of angle of rotation.

Generally, the one or more control units (21) together define at least a first and a second functional position (A,B) relative to the one or more control bases, the first and second functional positions (A,B) being located radially on opposite sides of the axis of rotation (rA) of the one or more control bases (20), the one or more control units being configured, regardless of the rotation of the one or more control bases (20), to produce a first control signal when activated at the first functional position (A) and to produce a second control signal when activated at the second functional position (B); the first control signal being configured to cause a first function having a first direction associated with it, and the second control signal being configured to cause a second function having a second direction associated with it, and where the second direction is opposite the first direction.

The term "direction" is meant to refer to any direction which can be described as a vector, for instance a movement forwards/backwards, up/down, slow/fast, high/low, left/right, and "a function having a direction associated with it" is meant to refer to functions such as a car driving forwards or backwards or turning up or down the volume of a sound or changing the brightness of a light.

FIG. 7 is a split sectional view of the housing (11), the control base (20) and an electromechanical interface (12). The electromechanical interfaces (12) comprise a spring element (24) and three annular rings (27).

The control base (20) is rotatable around the axis of rotation (rA), and the axis of rotation (rA) is perpendicular to a plane defined by the upper surface of the housing (11).

The electromechanical interface (12) comprises three coaxially arranged annular rings (27) having different radial diameters positioned in the same plane. The control bases (20) and the annular rings (27) are arranged coaxially along the axis of rotation (rA). The three coaxially arranged annular rings (27) have different radial diameter, such as to form an inner annular ring, an intermediate annular ring and an outer annular ring. The inner annular ring, the intermediate annular ring and the outer annular ring are positioned in a plane perpendicular to the axis of rotation (rA).

Generally, in some embodiments, the electromechanical interface (12) may comprise more than three annular rings (27), such as four annular rings, in order to provide additional regulation steps for the remote control device.

The control unit (21) comprises a protrusion (23) located on the axis of rotation (rA), whereon the control unit (21) and the spring element (24) may pivot allowing the end portions of the spring element (24) to engage with the annular rings (27).

All the components are arranged coaxially along the axis of rotation (rA).

The control unit (21) may comprise coupling means (22) such as an x-shaped aperture for allowing a toy building element to be coupled to the control unit, such as a shaft, to form a tiltable control stick.

FIG. 8 illustrates that the control unit (21) is structurally connected to the control base (20), such that when the control base (20) is rotated in the housing, the control unit (21) also rotates.

Figure 1:
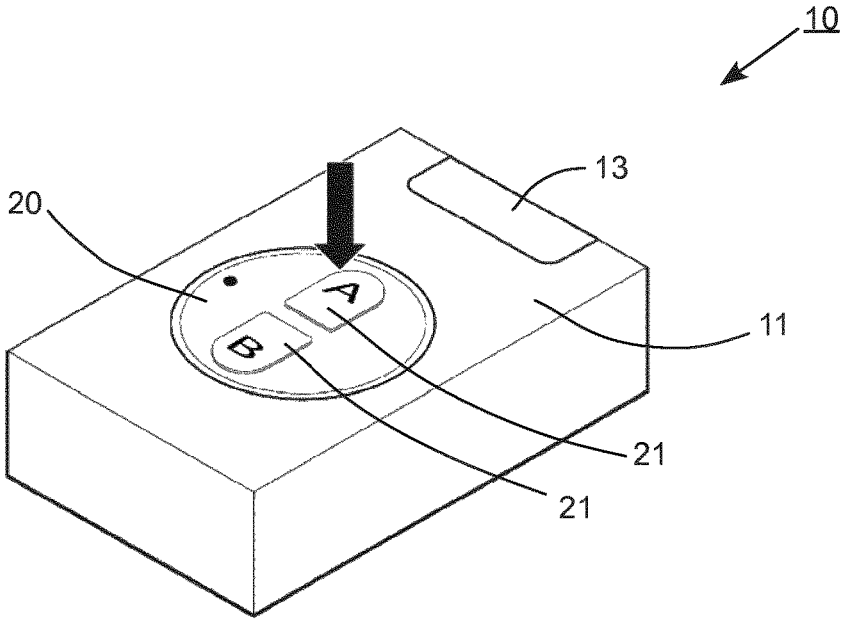
Figure 2:
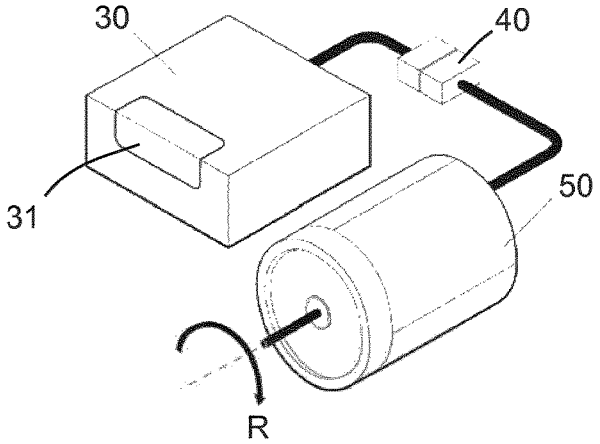
Figure 3:
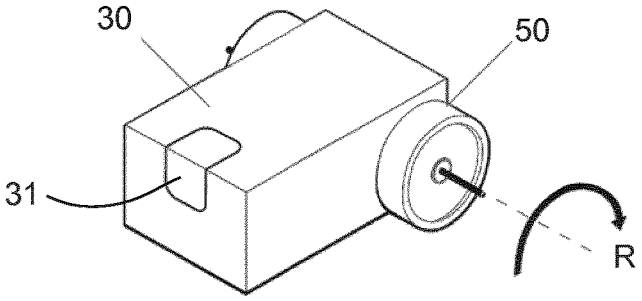
Figure 4:
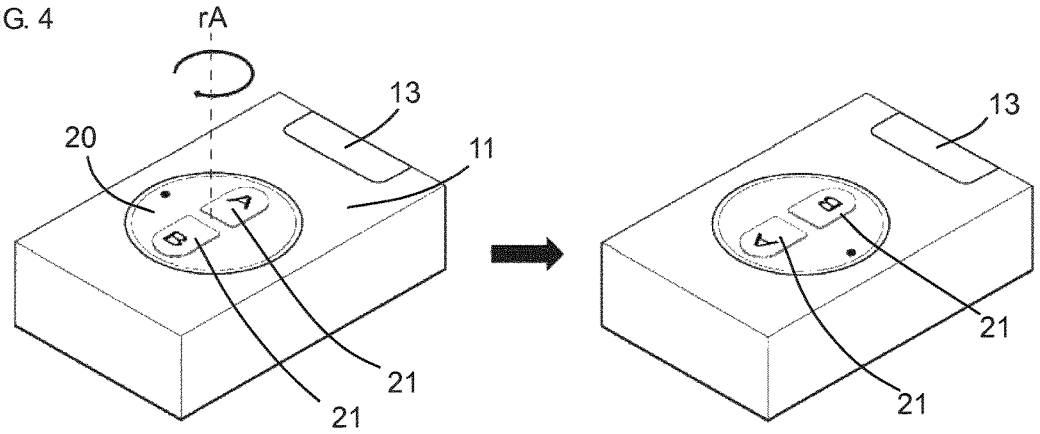
Figure 5:
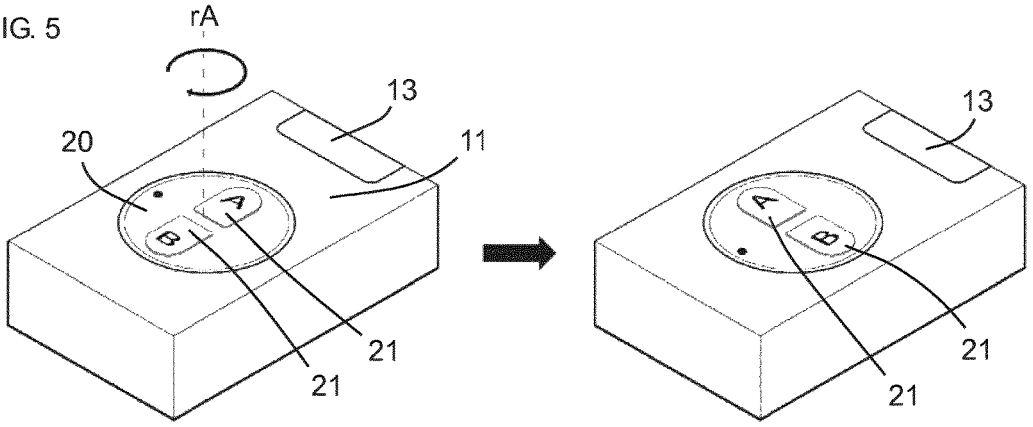
Figure 6:
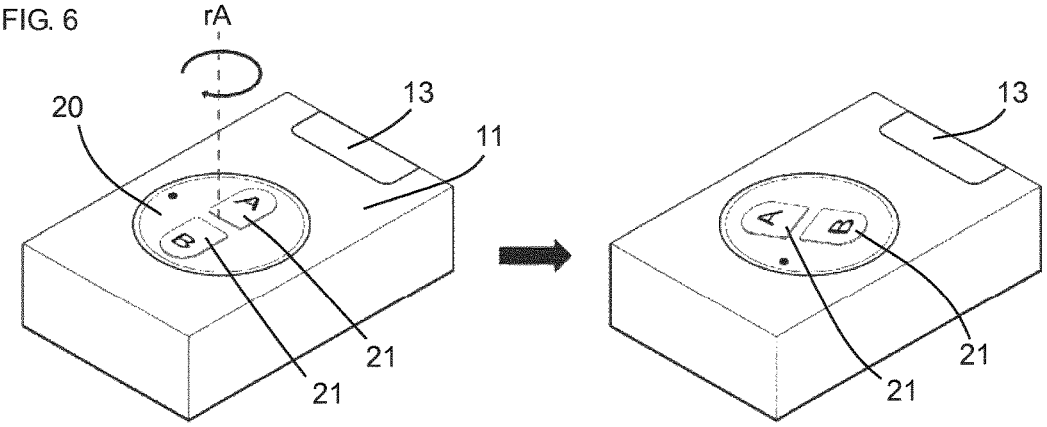
Figure 7:
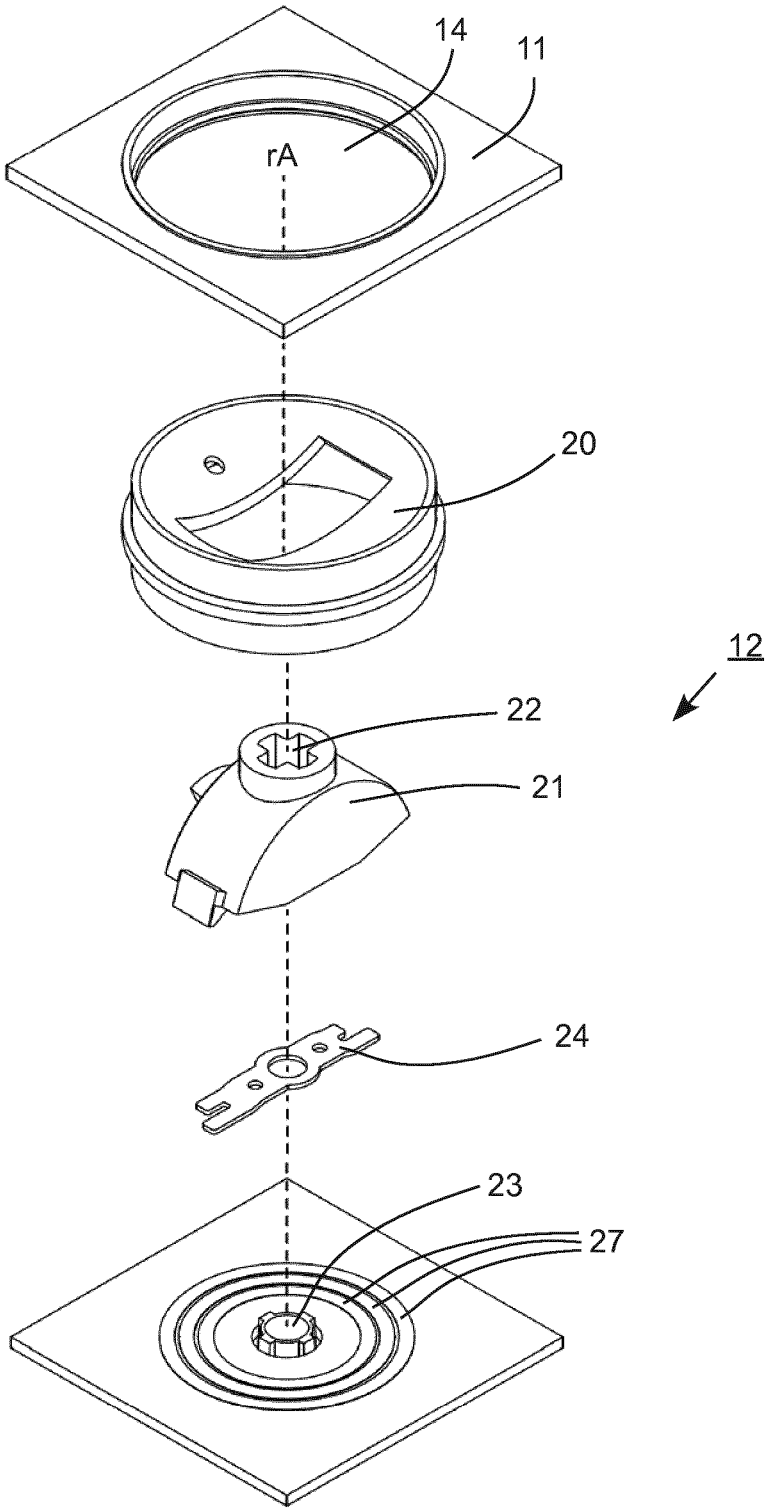
Figure 8:
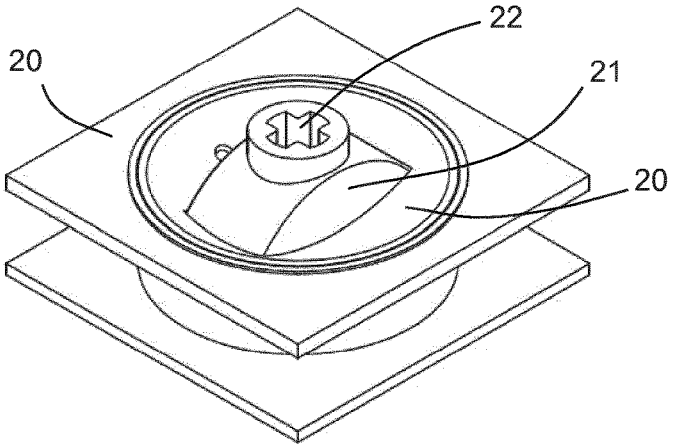
FIG. 8 shows a perspective view of the components shown in FIG. 7, when assembled.
Figure 9:
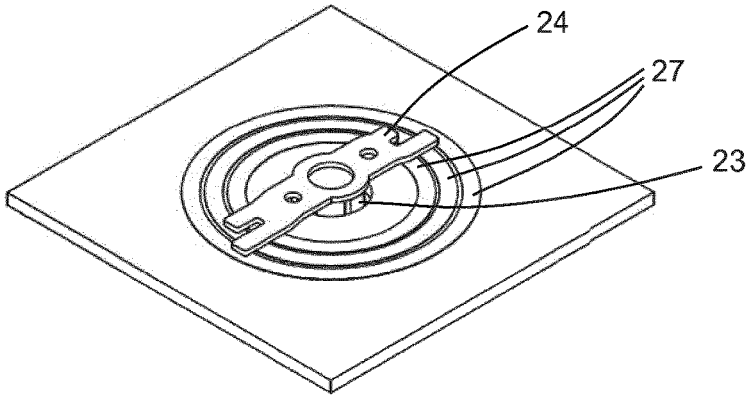
FIG. 9 shows, in a perspective view, the lower part of the electromechanical interface. The electromechanical interfaces (12) comprise a spring element (24) and three annular rings (27).
Figure 10:
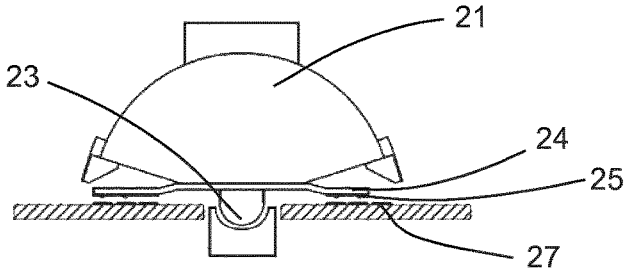
Figure 11:
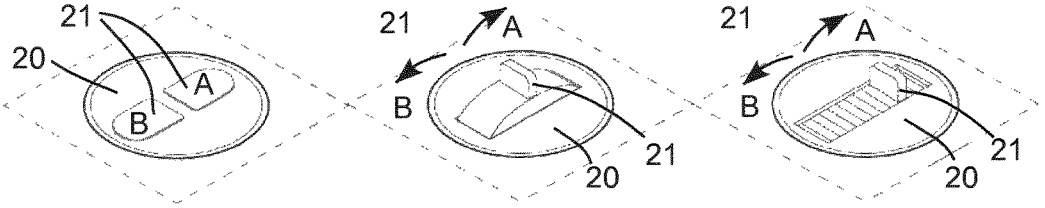

A side view of the control unit (21) and the electromechanical interface, as shown in FIG. 9, is shown in FIG. 10.

The spring element (24) comprises a first and a second set of contact surfaces (25). The first and second sets of contact surfaces (25) are positioned radially opposite each other in a distance from axis of rotation (rA). The first set of contact surfaces are configured for abutting the inner ring and the intermediate annular ring (27), respectively, and the second set of contact surfaces (25) are configured for abutting the intermediate annular ring and the outer annular ring (27). The centrally positioned protrusion (23) allows the spring element (24) to pivot and the end portions of the spring element (24) to connect with the annular rings (27), with the first or the second sets of contact surfaces (25), respectively. The contact surfaces (25) are arranged in the same distance as the annular rings (27) from the axis of rotation (rA) such that the contact surfaces (25) are aligned with the annular rings (27) to allow engagement. The engagement will be possible regardless of the orientation of the control base (20) and the control unit (21).

The control unit (21) comprises a protrusion (23) located on the axis of rotation (rA), whereon the control unit (21) and the spring element (24) may pivot allowing the control unit (21) to provide two different sets of data to the transmitter (13). By activating the control units (21), the spring (24) pivots and engages with the annular rings (27), with the first or the second sets of contact surfaces (25), respectively.

In FIGS. 8-11, the control base (20) comprises one or two control units (21) which are configured to provide two functional positions (A,B) enabling each control base (20) to provide two different sets of data to the transmitter (13) by the control units (21).

Generally, the one or more control units (21) together define at least a first and a second functional position (A,B) relative to the one or more control bases, the first and second functional positions (A,B) being located radially on opposite sides of the axis of rotation (rA) of the one or more control bases (20), the one or more control units being configured, regardless of the rotation of the one or more control bases (20), to produce a first control signal when activated at the first functional position (A) and to produce a second control signal when activated at the second functional position (B); the first control signal is configured to cause a first function having a first direction associated with it, and the second control signal is configured to cause a second function having a second direction associated with it, and where the second direction is opposite the first direction.

In FIG. 10 the one or more control units (21) are configured for at a given time to produce either the first or the second control signal.

Typically, each of the one or more control bases (20) comprise one or more control units (21) which are configured to provide at least two functional positions (A,B) enabling each of the one or more control bases (20) to provide two different sets of data to the transmitter (13) by the control units (21). The three different embodiments shown in FIG. 11 comprise two buttons, a tiltable control stick and a sliding knob, respectively, each embodiment providing two functional positions (A,B).

Figure 12:
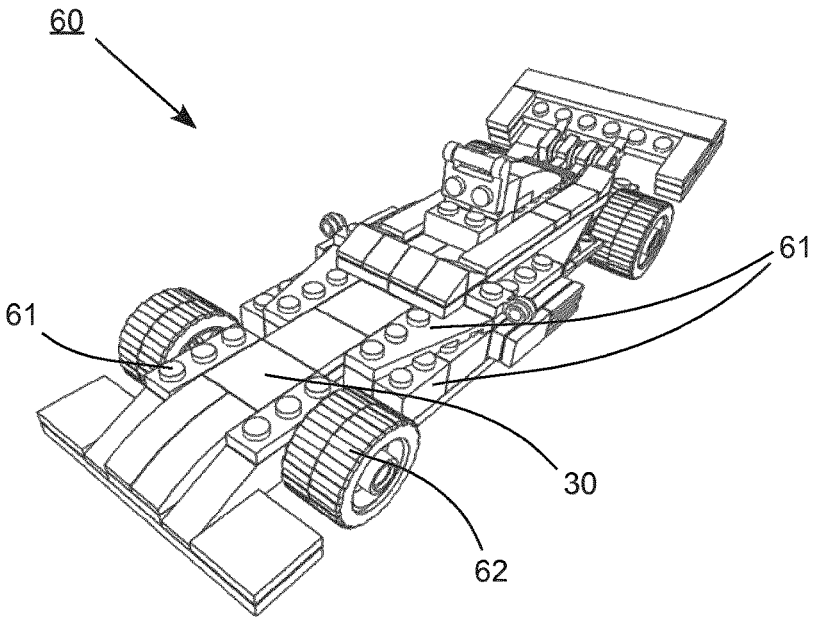

FIG. 12 illustrates a spatial structure (60), a toy construction model or other structure formed by two or more interconnected toy construction elements (61). The spatial structure (60) illustrated in the figure is in the shaped of a race car comprising wheels (62) and a registration unit (30) which is functionally connected to one or more remote controllable actuators.

Figure 13:
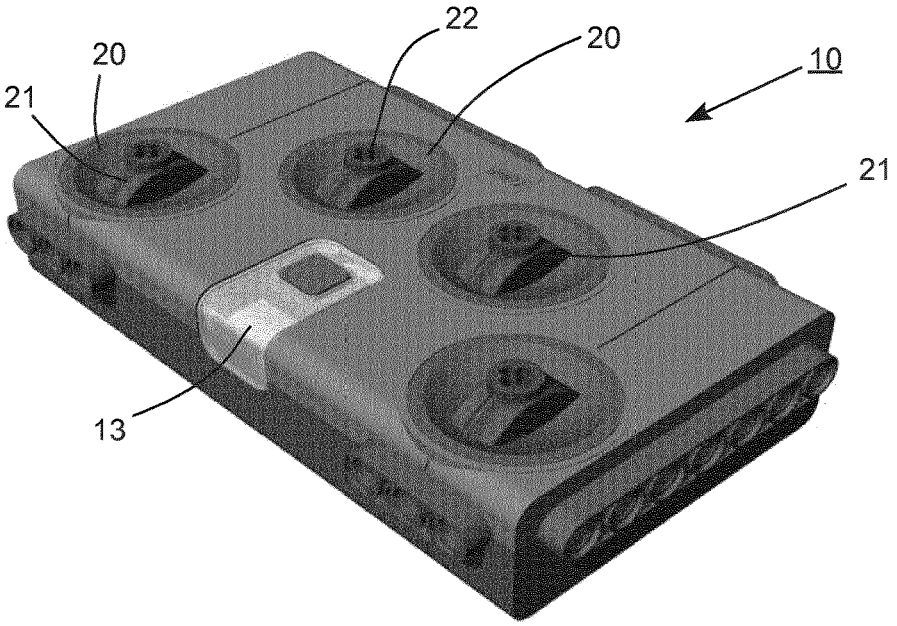

A remote control device for a reconfigurable toy such as a toy building set with remote controllable actuators is illustrated in FIG. 13. The remote control device (10) comprises a transmitter (13) and four rotatable control bases (20) each comprising a control unit (21). The control units (21) comprise coupling means (22) in the form of an x-shaped aperture for allowing a toy building element to be coupled to the control unit, such as a shaft, to form a tiltable control stick.

The remote control device may comprise a touch screen which comprises the adjustable control units (21). The touch screen is an electronic visual display that the user can control through simple or multi-touch gestures by touching the screen. Touch screens are common in a variety of electronic devices such as game consoles, personal computers, tablet computers and smartphones.

The figures illustrate that the transmitter (13) of the remote control device (10) responds to the manipulation of the control units (21) to transmit a signal from the transmitter (13) to the registration unit (30) comprising a receiver (31) which is functionally connected to one or more remote controllable actuators (50).

The remote controllable actuators (50) may provide a motion to a structure, for example a car constructed of toy construction elements (61) and one or more remote controllable actuators (50).

A user is enabled to adapt the remote control device for different use by changing the configuration or direction of the individual control units arranged in the remote control device.

A toy construction system comprises toy construction elements (60) and a remote control device (10) and one or more remote controllable actuators (50); said toy construction elements (60) comprise coupling members for detachably interconnecting the toy construction elements to create spatial structures comprising one or more remote controllable actuators (50); said remote control device comprises a housing (11), one or more control units (21), one or more electromechanical interfaces (12) and a transmitter (13); said one or more electromechanical interfaces (12) positioned inside said housing (11); said transmitter (13) being configured for transmitting control signals for controlling the one or more remote controllable actuators (50); said one or more control units (21) being functionally connected to said one or more electromechanical interfaces (12), which is functionally connected to said transmitter (13); said one or more control units (21) being mounted on one or more control bases (20), wherein the one or more control bases (20) are circular-shaped and rotatably arranged in the housing (11) of the remote control device (10).

A toy construction system comprising toy construction elements (60) and at least one remote control device (10) and one or more remote controllable actuators (50); said remote control device (10) being configured for transmitting control signals for controlling said one or more remote controllable actuators (50); said toy construction elements (60) comprising coupling members for detachably interconnecting the toy construction elements to create spatial structures comprising said one or more remote controllable actuators (50); said remote control device comprising a housing and one or more control units (21) configured such that a user may activate the remote control device by activating said one or more control units (21); said one or more control units (21) being adjustable, such that a user can change the orientation of the one or more controls unit with respect to the housing of the remote control device, said one or more control units together defining at least a first and a second functional position, said one or more control units being configured, to produce a first control signal when activated at said first functional position and to produce a second control signal when activated at said second functional position; said first control signal being configured to cause a first function having a first direction associated with it, and said second control signal being configured to cause a second function having a second direction associated with it, and where said second direction is opposite said first direction.

What is claimed is:

1. A toy construction system comprising toy construction elements and at least one remote control device and one or more remote controllable actuators;

said remote control device being configured for transmitting control signals for controlling said one or more remote controllable actuators;

said toy construction elements comprising coupling members for detachably interconnecting the toy construction elements to create spatial structures comprising said one or more remote controllable actuators;

said remote control device comprising a housing and one or more control units configured such that a user may activate the remote control device by activating said one or more control units;

wherein said one or more control units are adjustable, such that a user can change the orientation of the one or more controls unit with respect to the housing of the remote control device, and wherein said remote control device comprises one or more electromechanical interfaces and a transmitter;

said one or more control units being functionally connected to said one or more electromechanical interfaces which is functionally connected to said transmitter;

said one or more control units being connected to said one or more control bases, wherein the one or more control bases are arranged rotatable about an axis of rotation relative to the housing of the remote control device;

wherein said one or more control bases can rotate freely both clockwise and counterclockwise, said one or more control units together defining at least a first and a second functional position relative to the one or more control bases, said first and second functional positions being located radially on opposite sides of said axis of rotation of said one or more control bases, said one or more control units being configured, regardless of rotation of said one or more control bases, to produce a first control signal when activated at said first functional position and to produce a second control signal when activated at said second functional position;

said first control signal being configured to cause a first function having a first direction associated with it, and said second control signal being configured to cause a second function having a second direction associated with it, wherein said second direction is opposite said first direction.

2. A toy construction system according to claim 1, wherein said one or more control bases are configured for being positioned in any random user-defined angle of rotation.

3. A toy construction system according to claim 1, wherein the one or more control bases comprise one or more restriction elements which restrict movement in one direction and allow movement in the opposite direction by means of angled teeth in which a pawl, cog, or tooth engages, wherein the restriction elements may be configured to allow the one or more control bases to rotate and be set in 90 degree intervals around the axis of rotation.

4. The toy construction system according to claim 3, wherein the one or more restriction elements comprise a ratchet.

5. A toy construction system according to claim 1, wherein the remote control device is adapted such that control base can turn 180 degrees or 270 degrees clockwise around the axis of rotation, for changing direction.

6. A toy construction system according to claim 1, wherein said toy construction elements comprise at least two different types of coupling members, such as coupling studs and complementary coupling members.

7. A toy construction system according to claim 1, wherein said remote control device comprises a touch screen which comprises said one or more adjustable control units, such that said one or more control units together defining at least a first and a second functional position, said one or more control units being configured to produce a first control signal when activated at said first functional position and to produce a second control signal when activated at said second functional position; said first control signal being configured to cause a first function having a first direction associated with it, and said second control signal being configured to cause a second function having a second direction associated with it, and where said second direction is opposite said first direction.

8. A toy construction system according to claim 1, wherein said one or more control bases have a circular-shaped periphery rotatably arranged in the housing.

9. A toy construction system according to claim 8, wherein at least part of the circular periphery of said one or more control bases are rotatable within said housing.

10. A toy construction system according to claim 1, wherein said control bases are rotatable in an axis of rotation which is perpendicular to a plane defined by an outer surface of said housing.

11. A toy construction system according to claim 1, wherein each control base is structurally connected to one of the one or more electromechanical interfaces, said electromechanical interface comprising at least two coaxially arranged annular rings having different radial diameter, said control bases and said annular rings being arranged coaxially along the axis of rotation.

12. A toy construction system according to claim 11, wherein said electromechanical interface comprises three coaxially arranged annular rings having a radially increasing diameter to form an inner ring, an intermediate ring and an outer annular ring.

13. A toy construction system according to claim 12 wherein each of said one or more electromechanical interfaces comprises a coaxially arranged spring element which is configured for structurally connecting said spring element and said coaxially arranged annular rings when an input is provided to said one or more control units.

14. A toy construction system according to claim 13, wherein said spring element comprises a first and a second set of contact surfaces, said first and second sets of contact surfaces are positioned radially opposite each other in a distance from the axis of rotation, the first set of contact surfaces are configured for abutting said inner annular ring and said intermediate annular ring, respectively, and said second set of contact surfaces being configured for abutting said intermediate annular ring and said outer annular ring.

15. A toy construction system according to claim 11, wherein each of said one or more electromechanical interfaces comprises a coaxially arranged spring element which is configured for structurally connecting said spring element and said coaxially arranged annular rings when an input is provided to said one or more control units.

16. A toy construction system according to claim 15, wherein said spring element comprises a first and a second set of contact surfaces, said first and second sets of contact surfaces are positioned radially opposite each other in a distance from the axis of rotation.

17. A toy construction system according to claim 1, wherein each of the one or more control bases comprises one or more control units which are configured to provide at least two functional positions enabling each of the one or more control bases provide two different sets of data to the transmitter by the control units.

18. A toy construction system according to claim 1, wherein the one or more control units are shaped as two buttons, a sliding knob or in the form of a tiltable control stick.

19. A toy construction system according to claim 1, wherein the remote control device comprises 1-10 control bases.

20. A toy construction system according to claim 19, wherein the remote control device comprises an even number of control bases.

* * * * *